US005403234A

United States Patent [19]

Kuypers

[11] Patent Number: 5,403,234

[45] Date of Patent: Apr. 4, 1995

[54] RADON GAS EVALUATION SYSTEM AND METHOD

[76] Inventor: Fred A. Kuypers, 6110 Jennifer, Tinley Park, Ill. 60477

[21] Appl. No.: 139,507

[22] Filed: Oct. 19, 1993

Related U.S. Application Data

[62] Division of Ser. No. 835,227, Feb. 13, 1992, Pat. No. 5,288,268.

[51] Int. Cl.[6] ..... F24F 7/007

[52] U.S. Cl. ..... 454/345; 454/909

[58] Field of Search ..... 454/341, 343, 345, 909; 52/169.5

[56] References Cited

U.S. PATENT DOCUMENTS 2,733,668 2/1956 Pfetzing ..... 454/345 X

OTHER PUBLICATIONS

"Radon Reduction Technigues for Detached Houses", *Technical Guidance,* EPA/625/5-86/019, U.S. Environmental Protection Agency, Jun. 1986.

*Primary Examiner*—Harold Joyce

*Attorney, Agent, or Firm*—Potthast & Ring

[57] ABSTRACT

An apparatus for removing gas from above a floor slab of the interior living space of a structure to below the floor slab. The apparatus includes providing an opening which communicates from the top of the floor slab which communicates through the floor slab to the bottom of the floor slab. Further, this apparatus includes a device for imparting a partial vacuum in the opening to draw gas from above the floor slab to below the floor slab in association with the opening.

6 Claims, 1 Drawing Sheet

G
42
44
18
12
20
10
40
32
26
24
22
3
G
G
24
28
3
G
30
G
14
26
34
32
20

24
26
26
28

12
16
G
26
G
28
24
30
G
34
14
20

20
18

12
16
48
G
46
G
G
16
G
34
32
14
20
30

G
20
G
24
34'
16
28
12
30
14
20

RADON GAS EVALUATION SYSTEM AND METHOD

This application is a division of application Ser. No. 07/835,227, filed Feb. 13, 1992, now U.S. Pat. No. 5,288,268.

BACKGROUND OF THE INVENTION

1. Field of the Invention

The present invention relates to a system to remove gas from above a floor slab of the interior of a structure and a method to do the same and more particularly, an opening is provided between the top of the floor slab to below the floor slab and a partial vacuum is applied to the opening to draw gas from above the floor slab to below the floor slab.

2. Description of the Prior Art

A growing concern has evolved regarding accumulations of radioactive radon gas in homes and other inhabitable structures. Radon is created by the gradual decay of solid radioactive elements in the soil which then migrates toward the atmosphere and becomes trapped and accumulates in homes and buildings. It is also a concern to remove other noxious or deleterious gases at the same time from the interiors of structures. Such gases that can be unpleasant are sewer gas and musty odors caused by dampness.

Various systems are known which are used to pull undesirable gases such as radon from the ground substructure located below the floor slab of a building. However, none of these systems are pulling this undesirable gas from above the floor slab and removing it from the interior of the structure. This can be seen in U.S. Pat. No. 4,760,674, to Brand issued Aug. 2, 1988; U.S. Pat. No. 4,949,626, to Townsend issued Aug. 21, 1990; U.S. Pat. No. 4,885,984, to Franceus issued Dec. 12, 1989; and U.S. Pat. No. 4,938,124, to Garza issued Jul. 3, 1990.

In U.S. Pat. No. 3,975,467, to Beck issued Aug. 17, 1976, holes are provided along the base of a foundation wall for water and gas from the soil to pass into a constructed enclosure inside the building. This enclosure keeps the gas coming in from the holes from directly entering the interior living space of the structure. The enclosure is vented to the atmosphere outside of the structure to remove such gas. No provision is made to remove gas from the interior living space through the floor slab.

In U.S. Pat. No. 4,843,786, to Walkinshaw issued Jul. 14, 1989, provides an enclosure separating the interior living space from the floor slab of the structure. This enclosure is vented to the atmosphere. No provision is made for removal of gas from a floor slab in the interior living space of a structure to below the floor slab.

SUMMARY OF THE INVENTION

It is therefore an object of this invention to provide an apparatus for removing gas from above a floor slab of the interior living space of a structure to the juncture of the floor slab and a foundation wall, down along the foundation wall to and over a footing to below the floor slab. This apparatus has a means for providing an opening at the top of the floor slab at the juncture of the floor slab and the foundation wall, down along the foundation wall to a footing and extending away from the foundation wall over the footing to at least the distance the footing extends from the foundation wall. The apparatus further includes a means for imparting a partial vacuum in the opening means to draw gas from above the floor slab to below the floor slab in association with the opening means.

It is a further object of this invention to provide an apparatus to provide for removing gas from above a floor slab of the interior of a living space of a structure to below the floor slab. The apparatus has a means for providing an opening at the top of the floor slab which communicates through the floor slab to the bottom of the floor slab. It further has a means for imparting a partial vacuum to said opening means to draw gas from above the floor slab through the floor slab to below the slab in association with said opening means.

It is a further objective of this invention to provide a method of removing gas from above a floor slab of the interior of a living space of a structure to below said floor slab including the steps of placing an opening between the top of the floor slab to below the floor slab. The method further includes imparting a partial vacuum to said opening to draw gas from the top of said floor slab to below said floor slab.

BRIEF DESCRIPTION OF THE DRAWINGS

The foregoing objects and advantageous features of the invention will be explained in greater detail and others will be made apparent from the detailed description of the preferred embodiments of the present invention which is given with reference to the several figures of the drawing, in which.

DETAILED DESCRIPTION OF THE DRAWINGS

Figure 1:
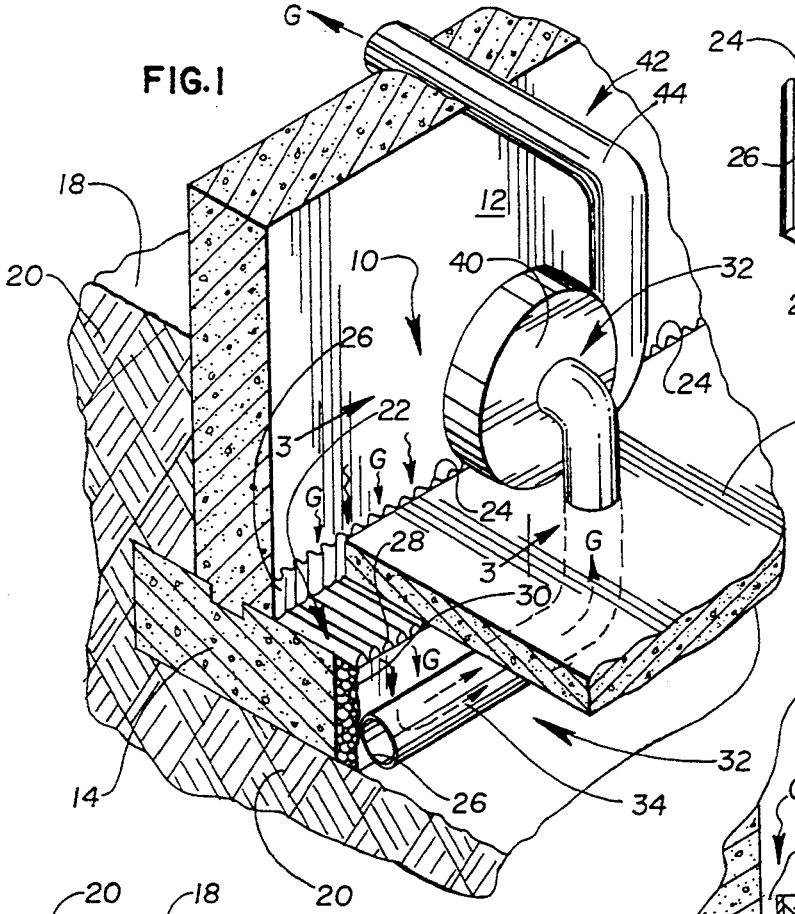
FIG. 1 is a perspective view of the apparatus for removing gas from above the floor slab of the interior living space of a structure in a partial cut away view of the structure.

Referring now to the drawings, gas G removal apparatus 10 can be seen in FIG. 1, installed in a typical living space structure environment. This structure often will be a basement of a residential home but could also be the lowest level of any other accommodation that people may occupy that will be in contact with the soil. As seen in FIG. 1, a typical structure may find a foundation wall 12 supported by a footing 14 which in turn provides some support for floor slab 16, all or part of which is located below grade 18 of soil 20.

Opening means 22 provides an opening 24 at the juncture of floor slab 16 and foundation wall 12 which communicates from the top of floor slab 16 down along foundation wall 12 to footing 14, thereafter extending away from foundation wall 12 over footing 14 to at least the distance footing 14 extends from foundation wall 12. Opening means 22 typically is a diverter device that is placed over footing 14 and against foundation wall 12 prior to pouring floor slab 16 and is described in further detail in U.S. Pat. No. 4,745,716 to Kuypers issued May 24, 1988.

Figure 2:
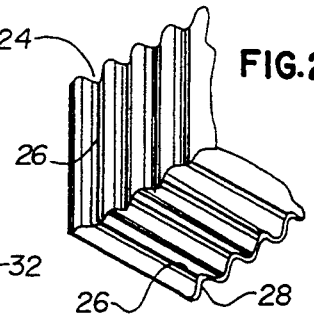
FIG. 2 is a perspective view of the channel member of the apparatus for removing gas from above the floor slab of the interior living space of a structure.
Figure 3:
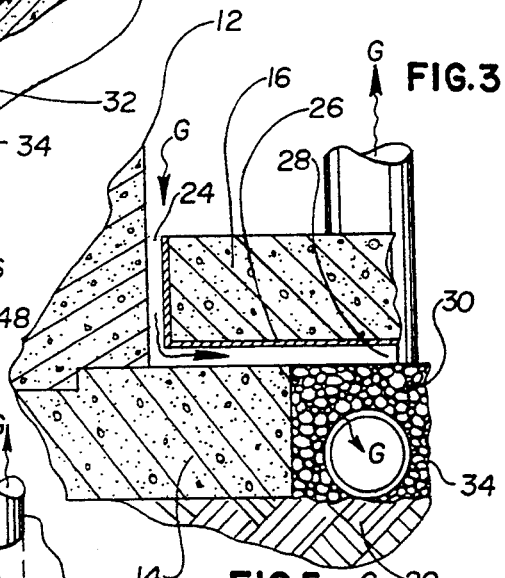
FIG. 3 is the cross sectional view along line 3—3 in FIG. 1.

Opening means 22 can come in many configurations, shapes and forms as set forth in U.S. Pat. No. 4,745,716. A mere sample of such configurations can be seen in FIG. 2 in which the configuration is channel members 26. Channel members 26 run from substantially the top of floor slab 16 down between foundation wall 12 and slab 16 to footing 14, over footing 14 away from foundation wall 12 to at least the distance footing 14 extends away from foundation wall 12. As can be seen channel members 26 provide multiple openings 24 near the top of floor slab 16 along the juncture of floor slab 16 and foundation wall 12 and likewise provide openings 28 at the other end of channel member 26 which are located at least to the full extension of footing 14 which is away from foundation wall 12. As can be easily appreciated opening means 22 has to be substantially near the top of floor slab 16 and at least to the end of footing 14 so as not to block off openings 24 and 28 respectively when floor slab 16 is poured.

Gas can move freely through opening means 22, from above floor slab 16 down to below floor slab 16 to the at least the end of footing 14. At this point, the end of footing 14, often an interstitial medium 30 is placed such as fill, crushed stone etc. that communicates with openings 28 of opening means 22. Interstitial medium 30 has air pockets or openings that permeate throughout it, thereby permitting gas to move from openings 28 into and through medium 30.

Figure 5:
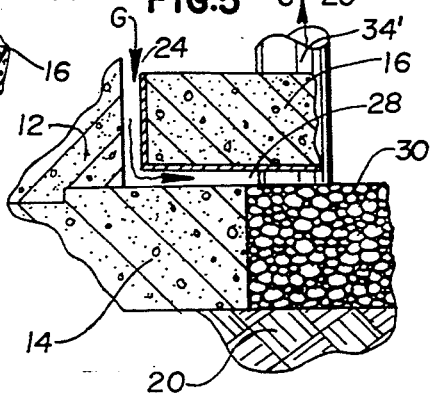
FIG. 5 is the sectional view along line 3—3 in FIG. 1 displaying a variation in partial vacuum imparting means.

Gas removal apparatus 10 also includes means for imparting a partial vacuum 32 in opening means 22 to draw gas from above floor slab 16 to below floor slab 16 which is in association with opening means 22. A typical vacuum imparting means 32 includes having a conduit 34 having sidewall 36 having openings 38 that is disposed in proximity to openings 28 of opening means 22 and is interconnected to pump 40. Conduit 34 can be constructed with many different materials such as drain tile that have openings at the joints or other positions or having PVC with holes in the sidewalls disposed in proximity to openings 28. Conduit 34 can be interconnected to numerous types of pumps such as air pumps, blowers etc. which can be powered numerous conventional ways electrically, electromechanically or even mechanically from the use of wind or moving water etc. So long as, pump 40 creates a partial vacuum in conduit 34 which in turn draws gas from outside conduit 34, through typically interstitial medium 30 in which conduit 34 is immersed, and thereby creates a partial vacuum in opening means 22, gas will be removed from the interior of the living space off of floor slab 16 and pulled to pump 40. Another variation on the means to impart a partial vacuum 32, seen in FIG. 5, is to have merely interstitial medium 30 in communication with openings 28 and pump 40. In this variation no conduit 34 would be necessary since pump 40 would impart a partial vacuum on interstitial medium 30 through conduit 34', seen in FIG. 5, a conduit that passes through slab 16 and communicates with medium 30 from above medium 30, which would in turn impart a partial vacuum in opening means 22 through openings 28.

Exhausting means 42 is provided typically in the form of conduit 44 in communication with the exhausted gas from pump 40 in which conduit 44 communicates with the atmosphere outside the interior living space of the structure thereby exhausting the undesirable gas to the outside and away from human contact in the structure.

Figure 4:
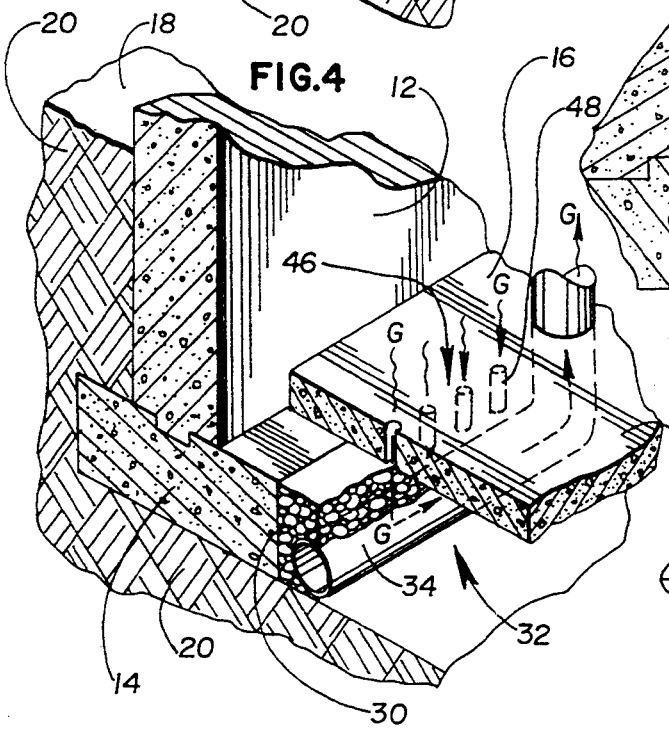
FIG. 4 is a perspective view of part of another embodiment the apparatus for removing gas from above the floor slab of the interior living space of a structure in a partial cut away view of the structure.

Another embodiment of this invention can be seen in FIG. 4. opening means 46 are provided at the top of floor slab 16 and communicate through floor slab 16 to the bottom of floor slab 16. Opening means 46 comprise hole 48 disposed through floor slab 16 which will often have a multiplicity of them to cover more areas of floor slab 16. Below floor slab 16 will be a means to impart a partial vacuum 32, as described above with pump 40 in conjunction with either, conduit 34 immersed in interstitial medium 30 that is located in proximity to hole 48 or merely interstitial medium 30 that is located in proximity to hole 48. As described in the first embodiment, gas will be drawn through holes 48 from the interior of the living space of the structure to below floor slab 16. Thereafter, gas G would be drawn into conduit 34 and carried to pump 40, as seen in FIG. 1. Gas G thereafter is exhausted to the atmosphere outside the interior living space through conduit 44, also seen in FIG. 1

The present invention includes a method for removing gas G from above floor slab 16 of the interior of a living space of a structure to below floor slab 16 which includes the step of placing an opening between the top of floor slab 16 to below floor slab 16. It further includes the step of imparting a partial vacuum to the opening to draw gas G from the top of floor slab 16 to below floor slab 16. As can be seen placing an opening can be placing hole 48 through floor slab 16 or it can be utilizing opening means 22 as described above and shown in FIG. 1. to provide the passageway for gas G to move from the top of floor slab 16 to below floor slab 16.

This method can also include exhausting gas G from below floor slab 16 to the atmosphere outside of the structure by utilizing such means for imparting a partial vacuum 32 and exhausting means 42 described above.

While a detailed description of the preferred embodiments of the invention have been given, it should be appreciated that many variations can be made thereto without departing from the scope of the invention as set forth in the appended claims.

I claim:

1. An apparatus for removing gas from above a floor slab of the interior of a living space of a structure to below the floor slab, comprising:

means for forming a uniform unrestricted opening from the top of the floor slab through the bottom of the floor slab to enable the free flow of the gas from the top of the slab to the bottom of the slab;

means for imparting a partial vacuum to said uniform unrestricted opening including a pump to draw the gas from above the floor slab freely through the floor slab to below the floor slab, in association with said uniform unrestricted opening; and an interstitial medium having openings in which the gas can pass through, in which some of said openings are in communication with said uniform unrestricted opening and with the pump that provides a partial vacuum in the interstitial medium and in turn in the uniform unrestricted opening to pull gas freely from above the floor slab through the unrestricted opening opening into the interstitial medium and to the pump.

2. The apparatus of claim 1, in which said opening means includes a hole disposed through said floor slab.

3. The apparatus of claim 1, in which said opening means includes a multiplicity of holes disposed in said floor slab.

4. The apparatus of claim 1, includes a conduit having openings in a sidewall of the conduit disposed in proximity to the opening means and in which the conduit is interconnected to said pump to provide a partial vacuum in the conduit and in turn in the opening means to pull gas from above the floor slab through the opening means and into the conduit to the pump.

5. The apparatus of claim 1, includes a means to exhaust the gas from said pump to the atmosphere outside said structure.

6. The apparatus of claim 5, in which said exhaust means includes a conduit in communication with said pump to receive said gas exhausted from said pump and in communication with the atmosphere outside said structure to exhaust said gas.

* * * * *